US009425569B2

(12) United States Patent
Lin

(10) Patent No.: US 9,425,569 B2
(45) Date of Patent: Aug. 23, 2016

(54) STORAGE DEVICE

(71) Applicant: PHISON ELECTRONICS CORP., Miaoli (TW)

(72) Inventor: Wei-Hung Lin, Hsinchu County (TW)

(73) Assignee: PHISON ELECTRONICS CORP., Miaoli (TW)

( * ) Notice: Subject to any disclaimer, the term of this patent is extended or adjusted under 35 U.S.C. 154(b) by 96 days.

(21) Appl. No.: 14/251,645

(22) Filed: Apr. 14, 2014

(65) Prior Publication Data

US 2015/0244125 A1 Aug. 27, 2015

(30) Foreign Application Priority Data

Feb. 27, 2014 (TW) ..... 103203483 U

(51) Int. Cl.
*H01R 27/02* (2006.01)
*H05F 1/00* (2006.01)
*H01R 13/648* (2006.01)

(52) U.S. Cl.
CPC ..... *H01R 27/02* (2013.01); *H01R 13/6485* (2013.01); *H05F 1/00* (2013.01)

(58) Field of Classification Search
CPC ..... H01R 31/06; H01R 27/00
USPC ..... 439/638, 640, 660, 172, 171
See application file for complete search history.

(56) References Cited

U.S. PATENT DOCUMENTS 7,779,199 B2 * 8/2010 Nishihara ..... G06F 12/0893 711/103
8,721,346 B2 * 5/2014 Lin ..... H05K 5/0278 439/10
2008/0022029 A1 * 1/2008 Chang ..... H01R 12/721 710/301
2008/0220636 A1 * 9/2008 Champion ..... H01R 13/665 439/131
2009/0113093 A1 * 4/2009 Chen ..... H01R 31/06 710/74
2009/0124104 A1 * 5/2009 Zhu ..... G06K 19/07 439/131
2009/0275224 A1 * 11/2009 Ni ..... G06K 19/07732 439/131
2010/0291783 A1 * 11/2010 Chang ..... H01R 13/6397 439/304
2010/0311257 A1 * 12/2010 Meng ..... H05K 5/0278 439/131
2013/0323951 A1 * 12/2013 Yu ..... H01R 31/065 439/218

* cited by examiner

*Primary Examiner* — Phuongchi T Nguyen
(74) *Attorney, Agent, or Firm* — Jianq Chyun IP Office

(57) ABSTRACT

A storage device includes a base and a storage unit. The base is a conductor of electricity. The storage unit has a first connecting interface and a second connecting interface. The storage unit is disposed on the base, and the base is electrically connected to the first connecting interface or the second connecting interface.

22 Claims, 5 Drawing Sheets

STORAGE DEVICE

CROSS-REFERENCE TO RELATED APPLICATION

This application claims the priority benefit of Taiwan application serial no. 103203483, filed on Feb. 27, 2014. The entirety of the above-mentioned patent application is hereby incorporated by reference herein and made a part of this specification.

BACKGROUND

1. Technology Field

The present invention relates to a storage device and more particularly relates to a storage device with two connecting interfaces.

2. Description of Related Art

With the development of multimedia technology, storage capacity required for digital data goes larger and larger. The conventional floppy disk in 1.44 MB features in its portable characteristic but still fails to meet the current requirement for large storage capacity. Although the conventional hard disk provides a large storage capacity, it is larger in size and is inconvenient for carrying about. In recent years, with the popularity of the universal serial bus (USB) interface and the decreasing price of the flash memory, many manufacturers have introduced various electronic products relating to flash memory. In particular, portable USB flash memory pen drive is a big success for it has advantages of large storage capacity, high compatibility, high portability, and hot plug function, and can be applied for data transmission between various computers and storage devices.

However, the existing electronic devices are equipped with various types of connectors, and the existing pen drives do not have preventive measures such as the so-called ground terminal. Thus, when the pen drive is connected to a corresponding slot of the electronic device through a connector of the pen drive or a conversion connector, electrostatic discharge or electromagnetic noise and interference cannot be prevented.

Nothing herein should be construed as an admission of knowledge in the prior art of any portion of the present invention. Furthermore, citation or identification of any document in this application is not an admission that such document is available as prior art to the present invention, or that any reference forms a part of the common general knowledge in the art.

SUMMARY

The present invention provides a storage device having two connecting interfaces, wherein an electrically conductive base is electrically connected to one of the connecting interfaces to prevent electrostatic discharge.

The present invention provides a storage device having two connecting interfaces, wherein an electrically conductive base is electrically connected to one of the connecting interfaces, and the base and the connecting interface are both accommodated in a non-electrically conductive case to prevent electrostatic discharge.

A storage device of the present invention includes a base and a storage unit. The base is an electrical conductor. The storage unit includes a first connecting interface and a second connecting interface. The storage unit is disposed on the base, and the base is electrically connected to the first connecting interface or the second connecting interface.

A storage device of the present invention includes a base, a storage unit, and a case. The base is an electrical conductor. The storage unit includes a first connecting interface and a second connecting interface. The storage unit is disposed on the base, and the base is electrically connected to the first connecting interface or the second connecting interface. The case is a non-electrical conductor. The base and the storage unit disposed on the base are assembled and accommodated in the case.

Based on the above, in the storage device of the above embodiments, the storage unit is provided with two connecting interfaces and disposed on the electrically conductive base, and the base is electrically connected to one of the connecting interfaces. Meanwhile, the base and the storage unit disposed thereon are assembled and accommodated in the case that is not electrically conductive. Therefore, when the user holds the storage device with his/her hand and connects the storage device to the external device, the electrical connection relationship between the base and the connecting interface is conducive to preventing damage of electronic components in the storage unit due to electrostatic discharge.

It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
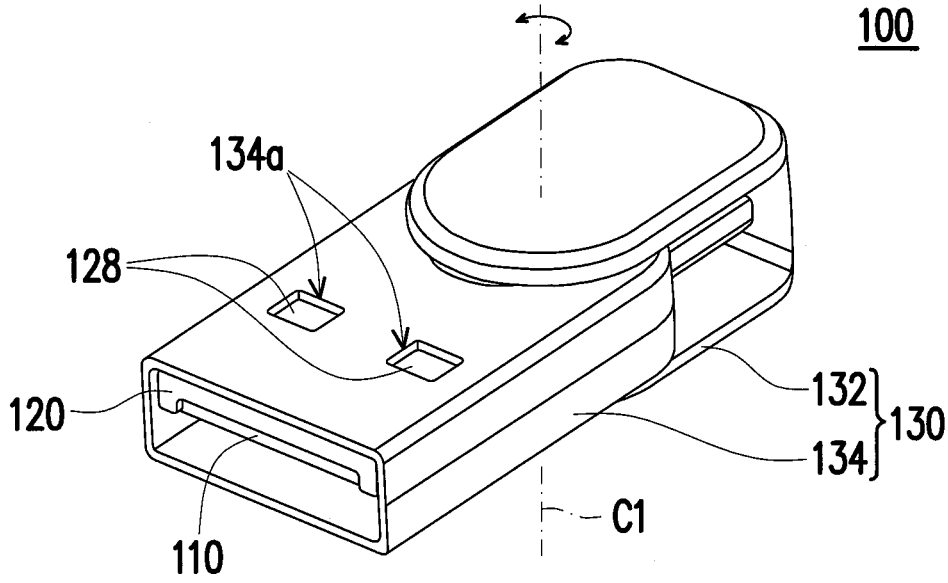
FIG. 1 is a schematic diagram of a storage device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Embodiments of the present invention may comprise any one or more of the novel features described herein, including in the Detailed Description, and/or shown in the drawings. As used herein, "at least one", "one or more", and "and/or" are open-ended expressions that are both conjunctive and disjunctive in operation. For example, each of the expressions "at least on of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein.

Figure 2:
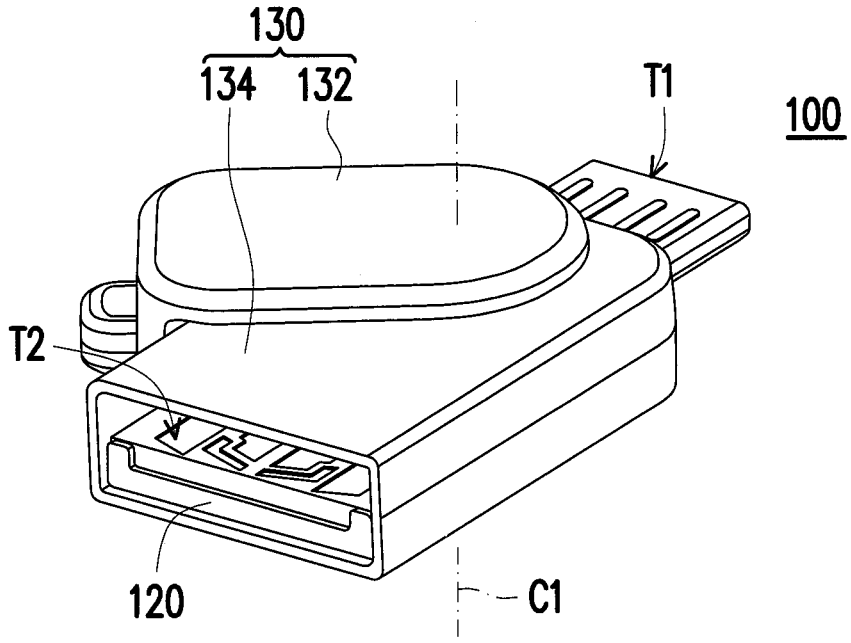
FIG. 2 is a schematic diagram illustrating another state of the storage device of FIG. 1.

FIG. 1 is a schematic diagram of a storage device according to an embodiment of the present invention. FIG. 2 is a schematic diagram illustrating another state of the storage device of FIG. 1. Referring to FIG. 1 and FIG. 2, in the present embodiment, a storage device 100 includes a storage unit 110, a base 120, and a case 130. The storage unit 110 is manufactured by system in package (SIP). That is, in a chip package 112, a die or a plurality of dies are included, and one or more of a passive element, a capacitor, a resistor, a connecting interface, an antenna, etc., is added for packaging.

The storage unit 110 has a first connecting interface T1 and a second connecting interface T2 of different specifications. The first connecting interface T1 and the second connecting interface T2 are disposed at two opposite ends of the chip package 112 and are electrically connected with each other correspondingly, which can be converted and connected by a switching circuit in the chip package 112 (not shown here). In the present embodiment, the first connecting interface T1 conforms to the connection standard of micro universal serial bus (Micro-USB) while the second connecting interface T2 conforms to the connection standard of universal serial bus (USB). Nevertheless, the present embodiment is not limited thereto. The designer may make any modification as appropriate according to the conditions of use of the storage device 100. Further, although the terminals described in the present embodiment conform to the current USB2.0 standard, the present embodiment is not limited thereto. In another embodiment not illustrated here, the formed connecting interfaces may also be applicable to a connection terminal conforming to the USB3.0 standard.

In addition, the case 130 of the present embodiment is a non-electrical conductor, and a material of the case 130 is plastic, for example. The case 130 includes a first case body 132 and a second case body 134, wherein the second case body 134 is pivoted to and held in the first case body 132. The storage unit 110 is disposed in the second case body 134, which allows the user to easily drive the second case body 134 and the first case body 132 to rotate with respect to each other around an axis C1 for switching to a state that the first connecting interface T1 or the second connecting interface T2 serves to connect the storage device 100 to an external device (not shown).

Figure 3:
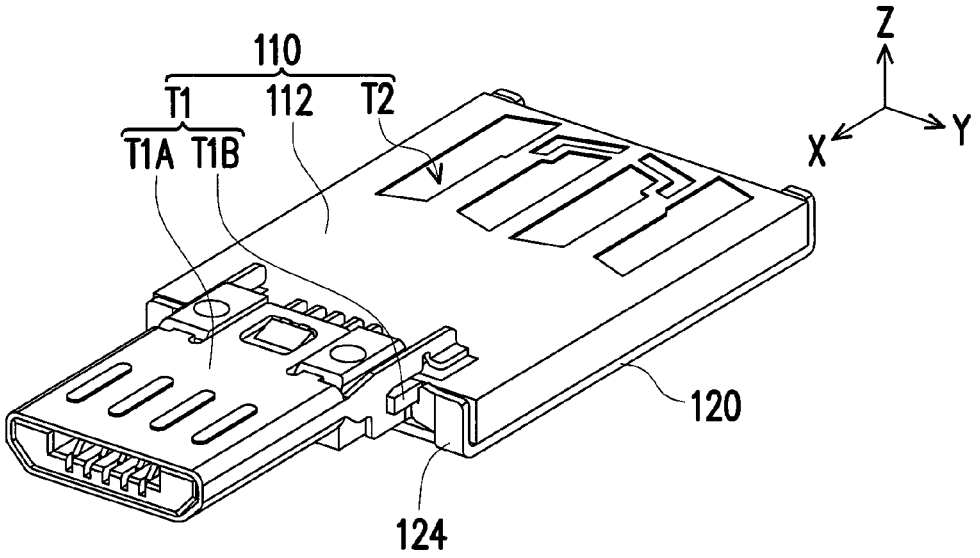
FIG. 3 is a schematic diagram illustrating a combination of a storage unit and a base of FIG. 1.
Figure 4:
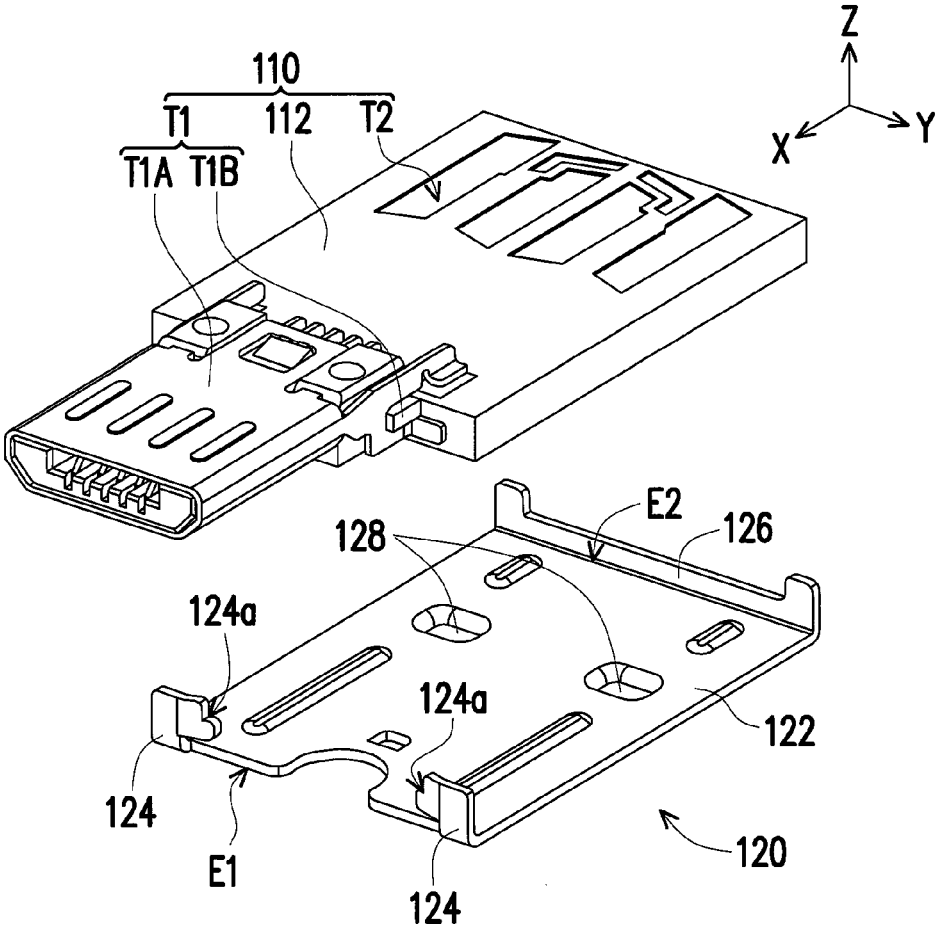
FIG. 4 is a schematic exploded diagram of the storage unit and the base of FIG. 3.

FIG. 3 is a schematic diagram illustrating a combination of the storage unit and the base of FIG. 1. FIG. 4 is a schematic exploded diagram of the storage unit and the base of FIG. 3. Referring to FIG. 2 to FIG. 4, in the present embodiment, the base 120 is an electrical conductor. A material of the base 120 is metal, for example. After the storage unit 110 is assembled on the base 120, this assembly is disposed to be accommodated in the second case body 134 of the case 130, such that the electrically-conductive base 120 is in contact with and between the storage unit 110 and the non-electrically conductive second case body 134.

The base 120 includes a plate body 122 and a pair of first locking portions 124 disposed opposite to each other, wherein each of the first locking portions 124 extends from the plate body 122 and is disposed upright at an edge E1 of the plate body 122. When the storage unit 110 is assembled to the base 120, the chip package 112 is carried on the plate body 122, and the first connecting interface T1 is locked between the first locking portions 124, as shown in FIG. 3. In terms of the structure, a root portion of the micro universal serial bus connector is locked between the first locking portions 124. In other words, based on the above, the base 120 which serves as the conductor is electrically connected to the first connecting interface T1, and further electrically connected to the second connecting interface T2 through the first connecting interface T1. However, the present embodiment is not limited thereto.

Specifically, with reference to FIG. 3 and FIG. 4, the first connecting interface T1 has a connecting portion T1A and a pair of ribs T1B. The ribs T1B are located at two opposite edges of the connecting portion T1A and are correspondingly locked to the first locking portions 124 respectively (due to the perspective, only one rib is illustrated in FIG. 3 and FIG. 4), such that the connecting portion T1A is held between the first locking portions 124. Further, the first locking portions 124 are a pair of bent elastic arms, and each of the bent elastic arms extends backward the first connecting interface T1 that the first locking portions 124 abut. The first locking portions 124 form a pair of L-shaped profiles with recesses 124*a* facing each other. That is, take the first locking portion 124 on the right side of FIG. 4 as an example, after extending from the plate body 122 in a positive Z-axis direction, the first locking portion 124 further extends in a negative Y-axis direction and in a negative X-axis direction (i.e. away from an extending direction of the first connecting interface T1). When the storage unit 110 is assembled to the base 120, the ribs T1B are correspondingly locked to the recesses 124*a* of the L-shaped profiles.

Moreover, the base 120 further includes a second locking portion 126 that extends from the plate body 122 and is disposed upright at another edge E2 of the plate body 122. The second locking portion 126 is opposite to the first locking portions 124 with the plate body 122 therebetween. Accordingly, when the storage unit 110 is assembled to the base 120, the first locking portions 124 of the base 120 provide a holding force for holding the storage unit 110 in the Y axis, and furthermore, the first locking portions 124 and the second locking portion 126 provide a holding force for holding the storage unit 110 in the X axis, so as to easily combine and fix the storage unit 110 and the base 120 together.

Figure 5:
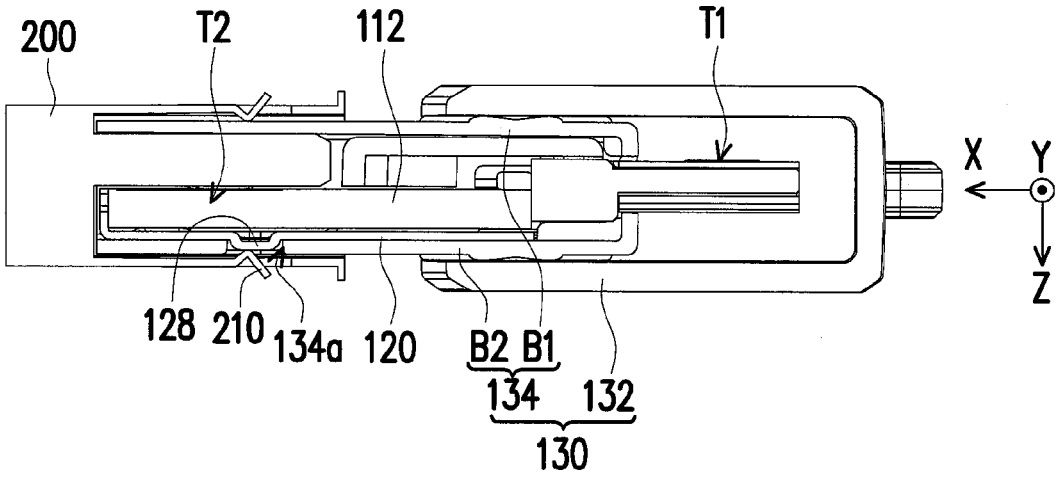
FIG. 5 is a schematic cross-sectional diagram of the storage device of FIG. 1 connected with an external device.
Figure 6:
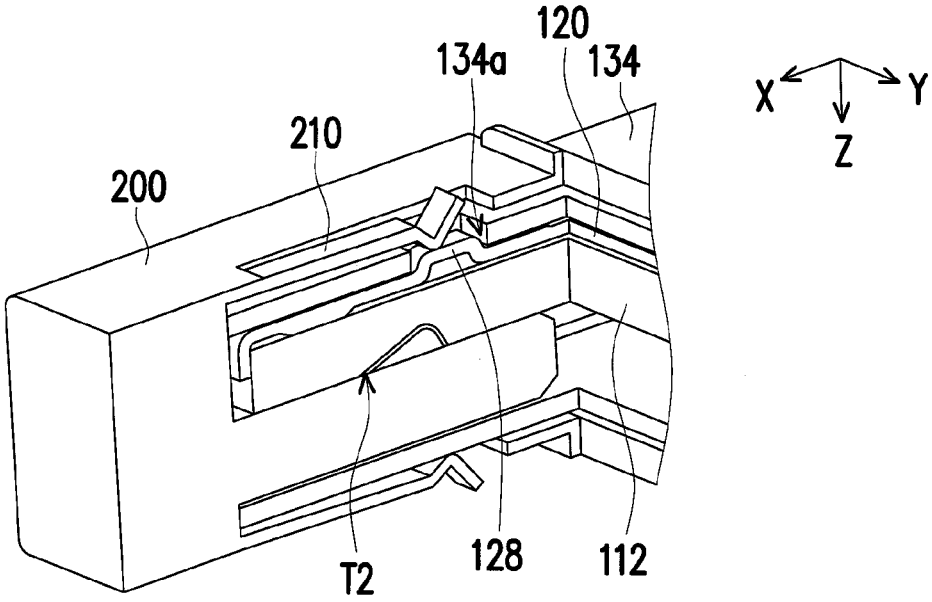
FIG. 6 is a schematic perspective diagram of the storage device and the external device of FIG. 5.

FIG. 5 is a schematic cross-sectional diagram of the storage device of FIG. 1 connected with the external device. FIG. 6 is a schematic perspective diagram of the storage device and the external device of FIG. 5. Here, the aforementioned external device is an external connector 200, for example. With reference to FIG. 4 to FIG. 6, in the present embodiment, the second case body 134 of the case 130 is formed by assembling an upper case body B1 and a lower case body B2. The second case body 134 further has a through hole 134*a* formed in the lower case body B2. The base 120 further includes a bump 128, as shown in FIG. 4, which extends from the plate body 122 in a negative Z-axis direction to be fitted to the through hole 134*a* when the base 120 is assembled to the second case body 134, so as to fix the components. In addition, the bump 128 is exposed outside the case 130 through the through hole 134*a*. When the storage device 100 is electrically connected to the external connector 200 via the second connecting interface T2, an elastic arm 210 of the external connector 200 passes through the through hole 134*a* to be electrically connected to the bump 128, which achieves an effect of grounding.

Figure 7:
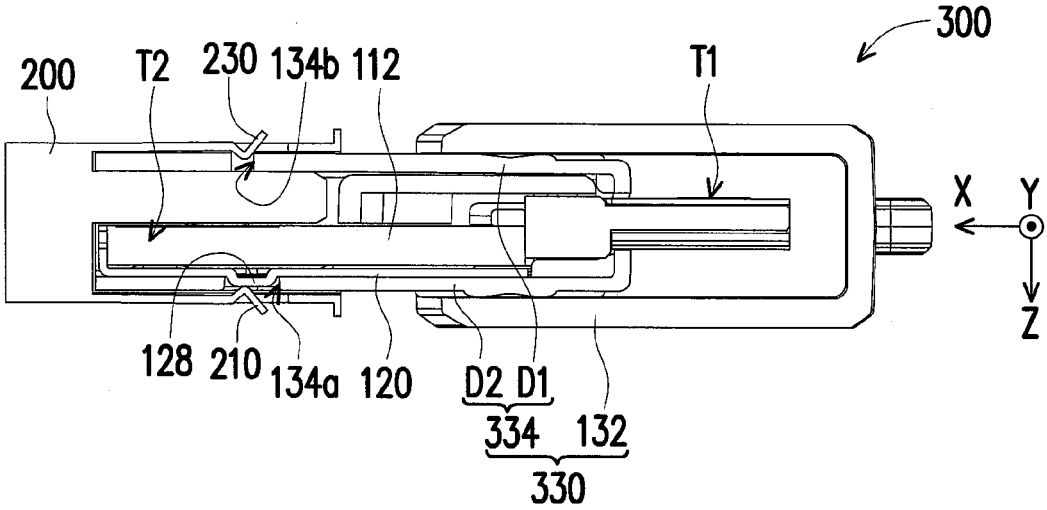
FIG. 7 is a schematic cross-sectional diagram illustrating a storage device connected with an external device according to another embodiment of the present invention.

FIG. 7 is a schematic cross-sectional diagram illustrating a storage device connected with an external device according to another embodiment of the present invention. Referring to FIG. 7, in a storage device 300 of the present embodiment, a second case body 334 of a case 330 is like the aforementioned second case body 134 and can be divided into an upper case body D1 and a lower case body D2 that are assembled to each other. The through hole 134*a* is still formed in the lower case body D2. A difference between the present embodiment and the previous embodiment is that: the second case body 334 of the storage device 300 further includes a through hole 134*b* formed in the upper case body D1, and correspondingly, the external connector 200 further has an elastic arm 230 to be locked to the through hole 134*b* when the storage device 300 and the external connector 200 are connected to each other, such that the storage device 300 is connected with and fixed to the external connector 200.

Figure 8:
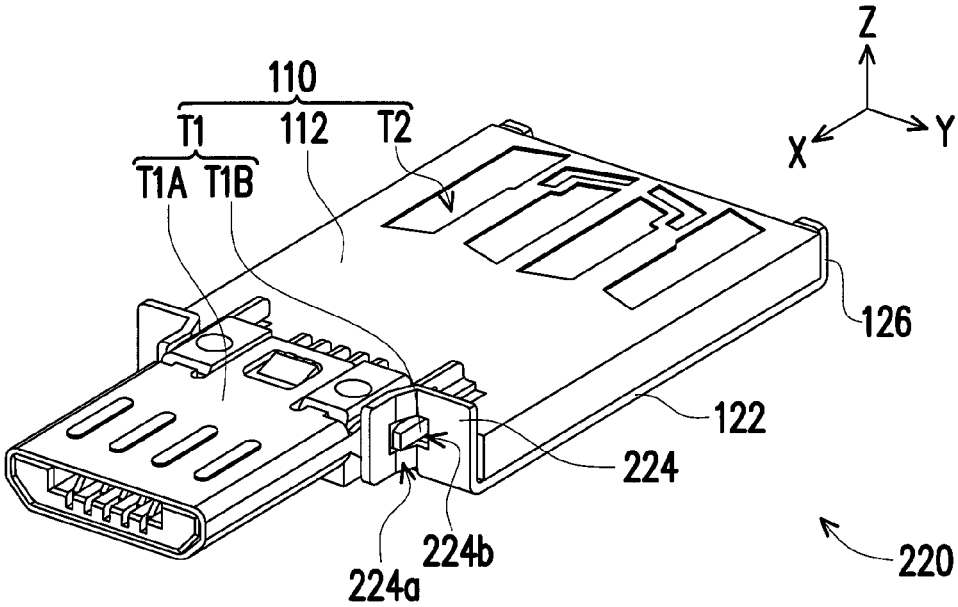
FIG. 8 is a schematic diagram illustrating a combination of a storage unit and a base according to another embodiment of the present invention.
Figure 9:
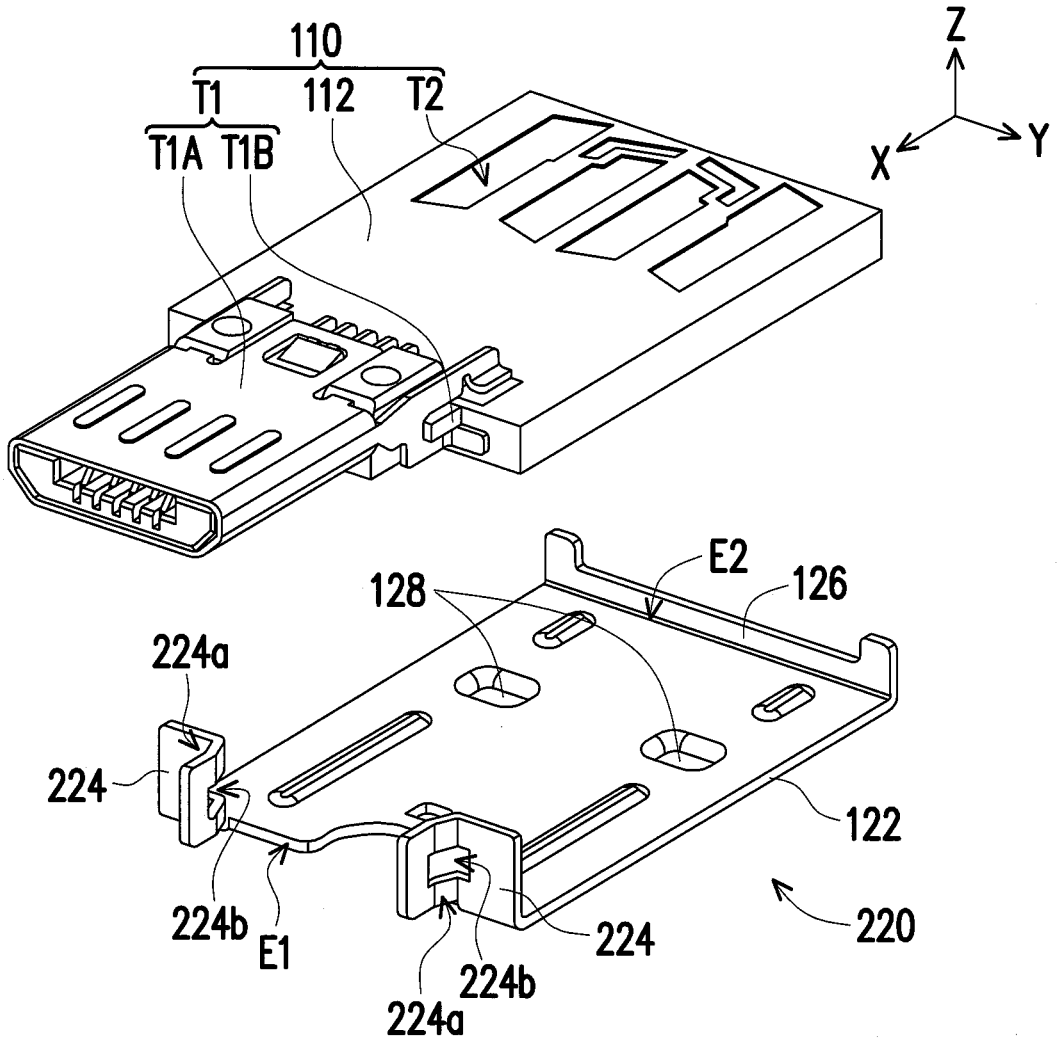
FIG. 9 is a schematic exploded diagram of the storage unit and the base of FIG. 8.

FIG. 8 is a schematic diagram illustrating a combination of a storage unit and a base according to another embodiment of the present invention. FIG. 9 is a schematic exploded diagram of the storage unit and the base of FIG. 8. With reference to FIG. 8 and FIG. 9, since the case 130 and the storage unit 110 of the present embodiment are the same as those of the previous embodiment, detailed structure of the storage unit 110 and the relationship between the case 130, the storage unit 110, and the base 120 are not repeated hereinafter.

A difference between the present embodiment and the previous embodiment lies in that: in the present embodiment, the first locking portions 224 are a pair of bent elastic arms extending toward the first connecting interface T1 that the first locking portions 224 abut. Because the first locking portions 224 are disposed in pair on the plate body, the first locking portion 224 on the right side of FIG. 8 is taken as an example hereinafter. To be more specific, after extending from the edge E1 of the plate body 122 in the positive Z-axis direction, the first locking portion 224 extends in the negative Y-axis direction and extends in the positive X-axis direction (i.e. toward the extending direction of the first connecting interface T1). Accordingly, the pair of the first locking portions 224 forms a pair of L-shaped profiles with recesses 224*a* facing away from each other, such that the connecting portion T1A of the first connecting interface T1 is held between the first locking portions 224 when the storage unit 110 is assembled on the base 220. Moreover, each of the first locking portions 224 has an opening 224*b*, which allows the rib T1B to pass through and be locked when the storage unit 110 is assembled to the base 220. Thus, the base 220 fixes the storage unit 110 thereon with the first locking portions 224 to complete the assembly.

To conclude the above, in the above embodiments of the present invention, the storage device is provided with two connecting interfaces and the pivot structure of the case of the storage device allows the user to rotate to switch to the required connecting interface. In addition, the case of the storage device is formed of a non-electrical conductor. The storage unit and the base are disposed in the case, wherein the base is an electrical conductor and is electrically connected to one of the connecting interfaces of the storage unit. Specifically, the locking portions that extend from the plate body of the base serve as the structures for electrically connecting the base to the connecting interface of the storage unit, and the locking portions also serve as the structures for combining the base with the storage unit. Therefore, with the configuration of the case of the storage device and the base and the storage unit in the case, the electrical connection relationship between the base and the connecting interface is conducive to preventing damage of the electronic components due to electrostatic discharge.

It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A storage device, comprising:

a base being an electrical conductor; and a storage unit comprising a first connecting interface and a second connecting interface, and the base being electrically connected to the first connecting interface or the second connecting interface, wherein the storage unit further comprises at least one memory chip, and the first connecting interface and the second connecting interface are structurally disposed on the base respectively.

2. The storage device according to claim 1, wherein the first connecting interface conforms to a micro universal serial bus (Micro-USB) while the second connecting interface conforms to a universal serial bus (USB).

3. The storage device according to claim 1, wherein the storage unit uses system-in-package design.

4. The storage device according to claim 1, further comprising:

a case in which the base and the storage unit disposed on the base are assembled and accommodated, and the case is a non-electrical conductor.

5. The storage device according to claim 4, wherein the case comprises a through hole and the base comprises a bump to be fitted to the through hole, and when the storage device is electrically connected to an external connector via the second connecting interface, an elastic arm of the external connector passes through the through hole to be electrically connected with the bump.

6. The storage device according to claim 1, wherein the base comprises a plate body and a pair of locking portions disposed opposite to each other, wherein each of the locking portions extends from the plate body and is disposed upright at an edge of the plate body, and the storage unit is assembled on the base such that the first connecting interface is electrically connected between the locking portions.

7. The storage device according to claim 6, wherein the first connecting interface comprises a connecting portion and a pair of ribs, and the ribs are disposed at two opposite edges of the connecting portion to be correspondingly locked to the locking portions, such that the connecting portion is held between the locking portions.

8. The storage device according to claim 6, wherein the locking portions are a pair of bent elastic arms, and each of the bent elastic arms extends backward the first connecting interface that the locking portions abut.

9. The storage device according to claim 8, wherein the locking portions form a pair of L-shaped profiles with recesses facing each other, and the ribs are correspondingly locked to the recesses of the L-shaped profiles.

10. The storage device according to claim 6, wherein the locking portions are a pair of bent elastic arms, and each of the bent elastic arms extend toward the first connecting interface that the locking portions abut.

11. The storage device according to claim 10, wherein each of the locking portions comprises an opening, and the ribs are respectively locked to the openings.

12. A storage device, comprising:

a base being an electrical conductor;

a storage unit comprising a first connecting interface and a second connecting interface, and the base being electrically connected to the first connecting interface or the second connecting interface, wherein the storage unit further comprises at least one memory chip, and the first connecting interface and the second connecting interface are structurally disposed on the base respectively; and a case being a non-electrical conductor, in which the base and the storage unit disposed on the base are assembled and accommodated.

13. The storage device according to claim 12, wherein a material of the base is metal and a material of the case is plastic.

14. The storage device according to claim 12, wherein the case comprises a through hole and the base comprises a bump to be fitted to the through hole, and when the storage device is electrically connected to an external connector via the second connecting interface, an elastic arm of the external connector passes through the through hole to be electrically connected with the bump.

15. The storage device according to claim 12, wherein the first connecting interface conforms to a micro universal serial bus (Micro-USB) while the second connecting interface conforms to a universal serial bus (USB).

16. The storage device according to claim 12, wherein the storage unit uses system-in-package design.

17. The storage device according to claim 12, wherein the base comprises a plate body and a pair of locking portions disposed opposite to each other, wherein each of the locking portions extends from the plate body and is disposed upright at an edge of the plate body, and the storage unit is assembled on the base such that the first connecting interface is electrically connected between the locking portions.

18. The storage device according to claim 17, wherein the first connecting interface comprises a connecting portion and a pair of ribs, and the ribs are disposed at two opposite edges of the connecting portion to be correspondingly locked to the locking portions, such that the connecting portion is held between the locking portions.

19. The storage device according to claim 17, wherein the locking portions are a pair of bent elastic arms, and each of the bent elastic arms extends backward the first connecting interface that the locking portions abut.

20. The storage device according to claim 19, wherein the locking portions form a pair of L-shaped profiles with recesses facing each other, and the ribs are correspondingly locked to the recesses of the L-shaped profiles.

21. The storage device according to claim 17, wherein the locking portions are a pair of bent elastic arms, and each of the bent elastic arms extends toward the first connecting interface that the locking portions abut.

22. The storage device according to claim 21, wherein each of the locking portions comprises an opening, and the ribs are respectively locked to the openings.

* * * * *